US005938428A

United States Patent [19]

Palmer et al.

[11] Patent Number: 5,938,428

[45] Date of Patent: Aug. 17, 1999

[54] SPARK IGNITER MECHANISM

[75] Inventors: Roger Palmer, Lockport; Mike Ridley, Holley; Al Hyde, Byron, all of N.Y.

[73] Assignee: Newell Operating Company, Freeport, Ill.

[21] Appl. No.: 08/907,603

[22] Filed: Aug. 8, 1997

[51] Int. Cl.[6] ..... F23Q 7/12; F23Q 7/06; F24C 3/00

[52] U.S. Cl. ..... 431/255; 431/258; 431/263; 431/264; 431/344; 431/253; 431/206; 126/25 A

[58] Field of Search ..... 431/255, 258, 431/254, 263, 264, 344, 206, 253; 126/25 A

[56] References Cited

U.S. PATENT DOCUMENTS

| | | | |
|---|---|---|---|
| 3,521,987 | 7/1970 | Goto | 431/255 |
| 3,655,324 | 4/1972 | Schweitzer | 431/258 |
| 3,793,561 | 2/1974 | Lundh | 431/255 |
| 3,802,828 | 4/1974 | Mercer et al. | 431/255 |
| 4,348,172 | 9/1982 | Miller | 431/255 |
| 4,526,532 | 7/1985 | Nelson | 431/255 |
| 4,881,894 | 11/1989 | Chapin et al. | 431/255 |
| 5,071,342 | 12/1991 | Yoshinaga | 431/255 |
| 5,374,185 | 12/1994 | Coulcher, Jr. et al. | 431/255 |
| 5,667,377 | 9/1997 | Lin | 431/344 |

*Primary Examiner*—Ira S. Lazarus
*Assistant Examiner*—David Lee
*Attorney, Agent, or Firm*—Foley & Lardner

[57] ABSTRACT

A spark igniter mechanism is provided for a torch having a burn tube. The spark igniter mechanism includes a one-piece housing and an igniter which is held against the burn tube by the housing. The igniter includes a spark wire which extends through an opening formed in a wall of the burn tube. The spark igniter mechanism further includes a fastener which secures the housing is to the burn tube. In addition, an adhesive may help to further secure the housing to the burn tube. The spark igniter mechanism of the present invention facilitates the use of a single igniter design with a plurality of torches. Furthermore, the mechanism is inexpensive to manufacture and assemble.

21 Claims, 3 Drawing Sheets

SPARK IGNITER MECHANISM

BACKGROUND OF THE INVENTION

1. Field of the Invention

The present invention relates generally to a torch. More particularly, the present invention relates to a spark igniter for use therewith. In its most preferred form the present invention relates to a three-piece spark igniter mechanism which includes: a one-piece housing; an igniter having a wire extending therefrom; and a fastener. The spark igniter mechanism may be used with hand-held torches, weed burners and the like.

2. Description of the Prior Art

A wide variety of torches are known which use combustible gas as a fuel. For example, hand-held torches which use propane or Mapp gas cylinders are well known in the art.

In recent years it has become relatively common to provide torches with spark igniter mechanisms in order to eliminate the need for flint-type spark ignition or ignition of the gas with a match or other source of flame. Torches have also been developed for a wider range of applications other than for welding, paint removal and the like. One such development is the use of torches for removing weeds. These torches are typically referred to as weed burners.

One common aspect of hand-held torches and weed burners is the addition of flame igniters along the burn tube of the product. Several prior art weed burners employ spark igniter mechanisms. These spark igniter mechanisms are described in the detailed description section of this specification, but it should be noted here that such mechanisms are relatively complicated and may require, in various cases, multi-component housings, ceramic stand-offs, single or multi-component sealing elements such as o-rings or rubber sleeves, or a plurality of fasteners to secure housing components together or to secure the mechanism and to locate it properly along the burn tube.

The complexity of these prior art spark igniter mechanisms adds to the costs of inventory, manufacture and assembly as well as to the ultimate cost to the consumer, thereby limiting the affordability of such products. Thus, it is desired to provide a simple spark igniter mechanism.

In addition to the desirability of having a simple spark igniter mechanism, it would be highly desirable for a manufacturer of torch products to be able to use a single spark igniter mechanism with a wide range of gas-burning products. For example, it would be extremely advantageous to have a spark igniter mechanism that may be mounted to various products, the common feature of which is a burn tube having an opening formed therein for receiving a spark wire of the spark igniter mechanism. Such capability would reduce the number of inventory parts or repair and replacement parts required for these products.

Providing a simple and reliable spark igniter mechanism that is readily adaptable for a variety of torch products including burn tubes would be a significant advance in this art.

SUMMARY OF THE INVENTION

The present invention features a spark igniter mechanism which includes a burn tube having a single opening formed in a side wall of the burn tube and an igniter located adjacent to the burn tube and having a spark wire extending therefrom and passing through the opening into the burn tube. The present invention also features a spark igniter mechanism in which a single fastener may be used to secure a spark igniter housing to the burn tube. In one form of the invention, the spark igniter mechanism is limited to three components and, optionally, may be held against the burn tube by an adhesive in addition to the fastener.

Another feature of the present invention is to use an elastomeric sealing component of the igniter as the sole elastomeric sealing element of the spark wire where it extends from the igniter into the burn tube.

The present invention also features a torch mechanism including a burn tube having a single opening formed in a side wall thereof, and a three-piece spark igniter mechanism including an igniter, a one-piece housing surrounding the igniter and the burn tube, and a fastener for securing the housing to the burn tube. The housing may be constructed from metal or plastic.

How the features of the present invention are accomplished will be described in the following detailed description of the preferred embodiment, taken in conjunction with the figures. Generally, however, the features are provided in a spark igniter mechanism employing an igniter having a plunger or trigger and a spark wire extending therefrom. An opening is provided in the burn tube to receive the spark wire such that, in the most preferred form, it passes just beyond the midpoint of the burn tube. A housing, which may be made from metal or plastic, and preferably is of a single-piece design, is slidably received over the burn tube so as to encase the igniter, when the spark wire is received in the opening of the burn tube. The housing is secured to the burn tube by a fastener, such as a set screw, and an adhesive may be employed as an additional securement. In its most preferred form, the igniter is held directly in contact with the wall of the burn tube such that a portion of the igniter directly adjoins and surrounds the opening of the burn tube at the location where the spark wire enters the burn tube. If the spark wire is sealed into the igniter by an elastomer, the elastomer may also assist in preventing gas leakage from the burn tube into the housing. In the preferred form, this elastomer would be the only elastomeric sealing element employed in the spark igniter mechanism of the present invention.

Other ways in which the features of the invention are accomplished will become apparent to those skilled in the art, upon reading the present specification. These alternatives are deemed to fall within the scope of the present invention, if they fall within the scope of the claims which follow.

DESCRIPTION OF THE FIGURES

The present invention will become more fully understood from the following detailed description, taken in conjunction with the accompanying drawings, wherein like reference numerals denote like elements, in which.

DETAILED DESCRIPTION OF THE PREFERRED EMBODIMENT

Figure 1:
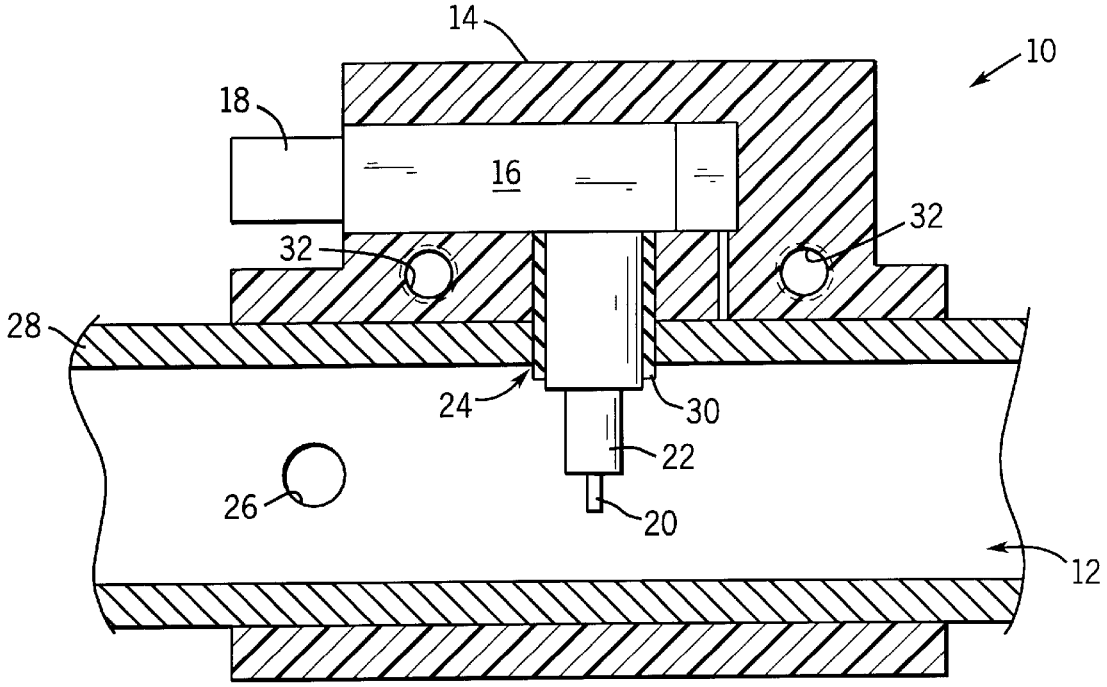
FIG. 1 PRIOR ART
FIG. 1 is a schematic, cross-sectional view of a first prior art spark igniter mechanism shown coupled to a burn tube.
Figure 2:
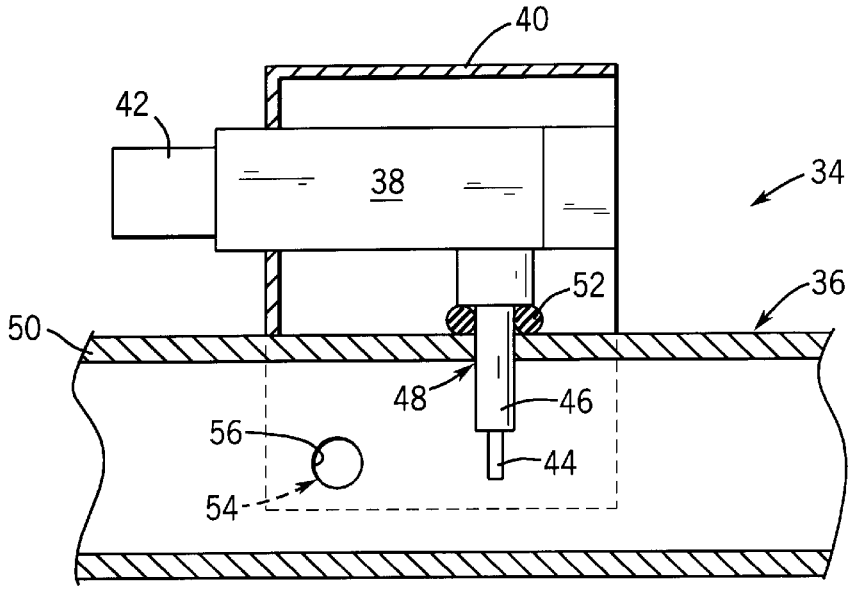
FIG. 2 PRIOR ART
FIG. 2 is a schematic, cross-sectional view of a second prior art spark igniter mechanism shown coupled to a burn tube.
Figure 3:
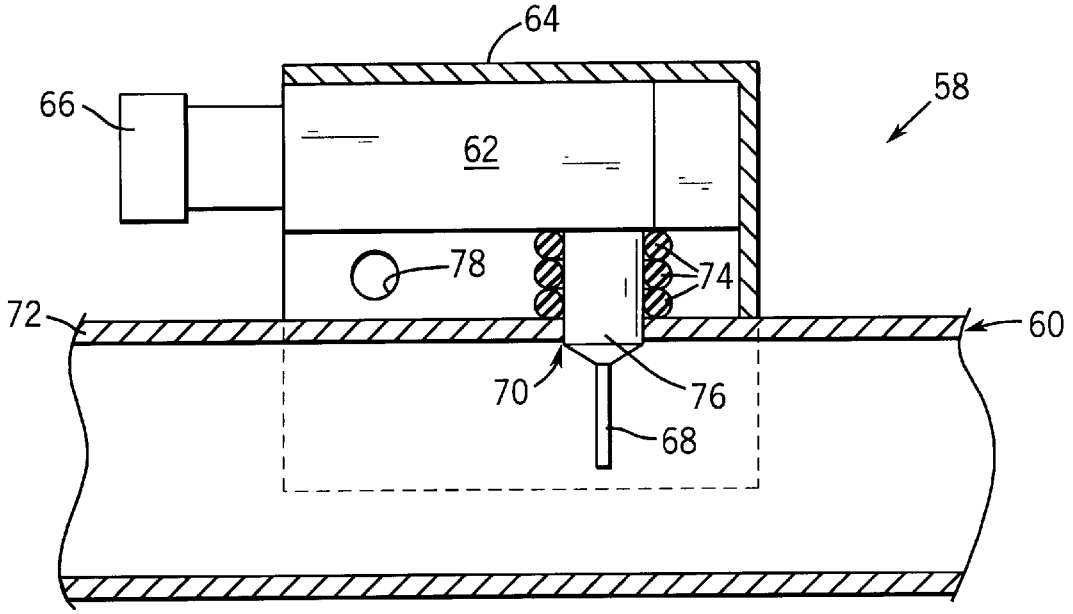
FIG. 3 PRIOR ART
FIG. 3 is a schematic, cross-sectional view of a third prior art spark igniter mechanism shown coupled to a burn tube.

Before proceeding to the detailed description of the preferred embodiment, reference is first made to FIGS. 1–3 which illustrate several prior art spark igniter mechanisms which use special, ceramic-insulated spark wires. Referring first to FIG. 1, a spark igniter mechanism 10 is shown attached to a burn tube 12. Spark igniter mechanism 10 includes a housing 14 which encases an igniter 16. Igniter 16 includes a plunger or trigger 18 and a spark wire 20 which is insulated by a ceramic cylinder 22.

Burn tube 12 has two openings 24 and 26 formed in a side wall 28 of burn tube 12. Opening 24 receives ceramic-insulated spark wire 20 of igniter 16, when igniter 16 is attached to burn tube 12. Opening 26 receives a projection (not shown) from housing 14 to locate housing 14 along burn tube 12. Housing 14 secures igniter 16 to burn tube 12. Housing 14 includes two pieces of molded plastic, only one of which is shown, which mate to encase igniter 16 and burn tube 12. Housing 14 also has a pair of holes 32 formed therein for receiving screws (not shown) to hold housing 14 together. In order to prevent any gas within burn tube 12 from leaking into housing 14, spark igniter mechanism 10 includes a rubber sleeve 30 to provide an air-tight seal where spark wire 20 enters opening 24.

FIG. 2 illustrates another prior art spark igniter mechanism 34 attached to a burn tube 36. Spark igniter mechanism 34 is similar to spark igniter mechanism 10 in that it includes an igniter 38 encased in a two-piece, metal housing 40. Igniter 38 has a trigger 42 and a spark wire 44 which extends from igniter 38. Spark wire 44 is surrounded by a ceramic cylinder 46 which provides insulation.

When spark igniter mechanism 34 is coupled to burn tube 36, spark wire 44 extends into an opening 48 in a side wall 50 of burn tube 36. An o-ring 52 mounted on ceramic cylinder 46 seals opening 48 to prevent the escape of gas from burn tube 36. The two halves of housing 40 join to secure spark igniter mechanism 34 to burn tube 36. Each half of housing 40 has an aperture 54 formed therein. Apertures 54 of housing 40 align with an opening 56 that extends through opposing side walls 50 of burn tube 36. Apertures 54 and opening 56 receive a pair of rivets (not shown) which fasten housing 40 to burn tube 36.

A third prior art spark igniter mechanism 58 is mounted to a burn tube 60, as illustrated in FIG. 3. Spark igniter mechanism 58 includes an igniter 62 and a housing 64. Igniter 62 includes a trigger 66 and a spark wire 68 extending from the body of igniter 62. Burn tube 60 has a single opening 70 formed in a side wall 72 which receives spark wire 68, when spark igniter mechanism 58 is mounted on burn tube 60. Three o-rings 74 surround ceramic cylinder 76 of spark wire 68 to seal the gap between spark wire 68 and burn tube 60.

Housing 64 is a single-piece unit which is stamped from metal. Housing 64 has an aperture 78 formed therein for receiving a nut and bolt fastener (not shown) which maintains housing 64 over igniter 62 and burn tube 60.

A problem with each of these prior art spark igniter mechanisms is the complexity of their design. The number of parts required to construct each of these mechanisms increases both inventory and manufacture costs. In addition, each of the above mechanisms requires a special igniter having a ceramic-insulated spark wire which is thicker than a plastic-wrapped wire. Thus, to receive these ceramic-insulated spark wires, the openings in the burn tubes must be larger, typically of a diameter of about 0.250 to 0.300 inches. Elastomeric sealers such as o-rings and rubber sleeves are also required to provide an airtight seal between the spark wire and the burn tube.

Figure 4:
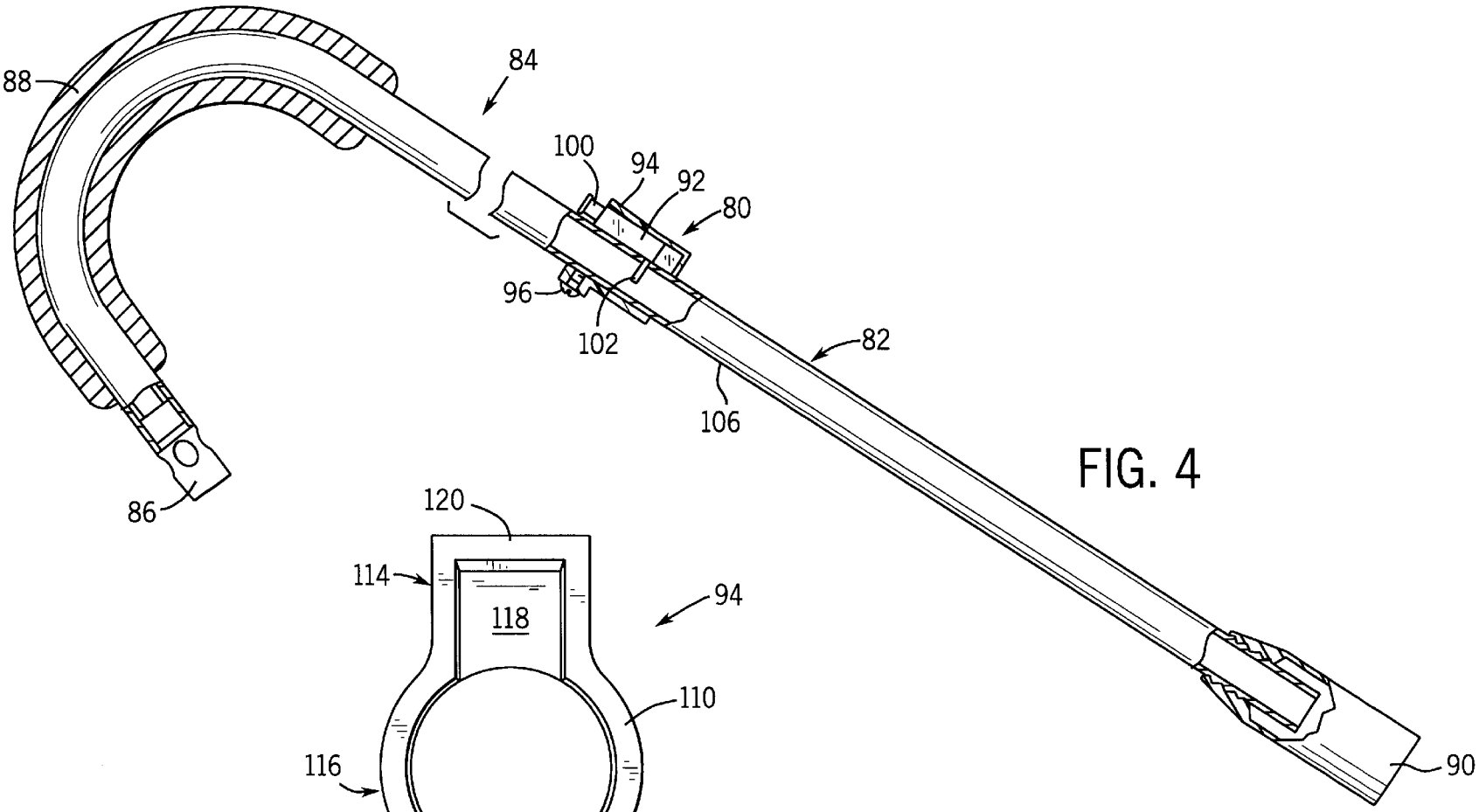
FIG. 4 is a partially broken-away, perspective view of a spark igniter mechanism, in accordance with the present invention, coupled to a burn tube of a weed burner.

The spark igniter mechanism of the present invention is much simpler than its prior art counterparts. As shown in FIG. 4, a spark igniter mechanism 80, in accordance with the present invention, is shown coupled to a burn tube 82 of a torch such as a weed burner 84. Weed burner 84 has a first end 86 for attaching a cylinder of fuel gas (not shown), a curved section 88, and a second end 90 from which a flame projects. Spark igniter mechanism 80 is located along burn tube 82 between curved section 88 and second end 90.

Figure 5:
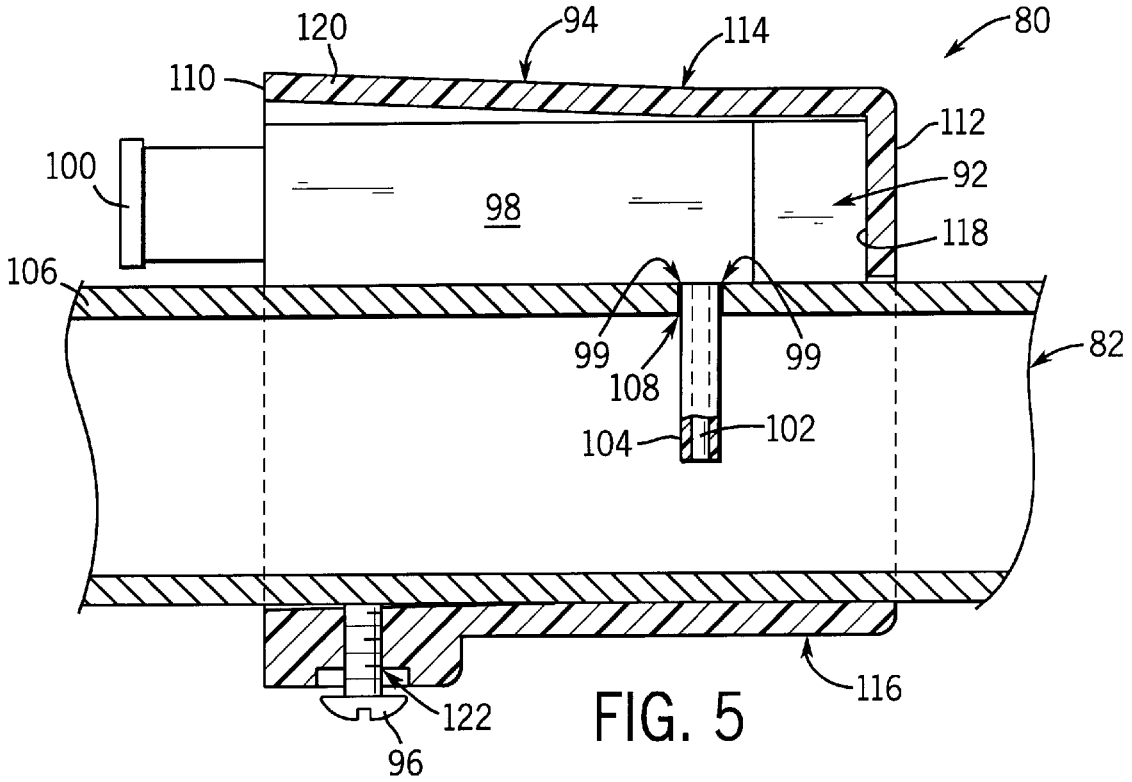
FIG. 5 is an enlarged, schematic, cross-sectional view of the spark igniter mechanism and burn tube shown in FIG. 4.
Figure 6:
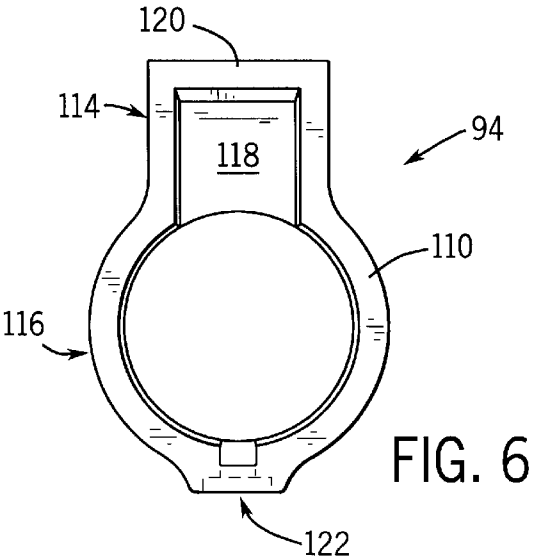
FIG. 6 is an end view of a housing of the spark igniter mechanism.

As shown more clearly in FIGS. 5 and 6, spark igniter mechanism 80 includes three main components: an igniter 92; a one-piece housing 94; and a screw or other mechanical fastener 96. Igniter 92 includes a body 98 having a longitudinal axis and a trigger 100 located at one end thereof. Trigger 100 is slidably received in igniter body 98. Extending from igniter body 98 and projecting transverse to the longitudinal axis of body 98 is a spark wire 102. A portion of spark wire 102 that is located within igniter body 98 is secured in place by a soft glue or adhesive 99. Spark wire 102 is surrounded by a standard, plastic insulator 104. Plastic insulator 104 is much thinner than ceramic cylinders 22, 46 and 76 of spark igniter mechanisms 10, 34 and 58, respectively. In the preferred embodiment, insulated spark wire 102 has a diameter of about 0.070 inches.

Burn tube 82 has a cylindrical side wall 106 next to which igniter 92 is placed. Side wall 106 has an opening 108 (FIG. 5) formed therein for receiving insulated spark wire 102. Spark wire 102 is trimmed so that it extends into burn tube 82 just beyond the longitudinal axis of tube 82. Since spark wire 102 is insulated with a regular plastic material, opening 108 is substantially smaller than openings 24, 48 and 70 in respective burn tubes 12, 36 and 60. In the preferred embodiment, opening 108 is approximately 0.076 inches in diameter. Since opening 108 is substantially smaller, less gas is likely to escape from burn tube 82 and into spark igniter mechanism, and soft glue 99 which secures spark wire 102 in igniter body 98 is sufficient to help seal this gap. As a result, the need for o-rings or rubber sleeves is eliminated, and igniter body 98 may be placed directly in contact with side wall 106 of burn tube 82, providing a compact spark igniter mechanism.

When igniter 92 is coupled to burn tube 82, housing 94 encases igniter 92 and burn tube 82 to hold them together. Housing 94, as best illustrated in FIGS. 5 and 6, is a single-piece unit which may be made of a moldable, plastic material. Alternatively, housing 94 may be cast or stamped from metal. Housing 94 has a front end 110 and a back end 112. The view from front end 110 shows that housing 94 has a generally rectangular portion 114 attached to a circular portion 116. Circular portion 116 receives burn tube 82, while rectangular portion 114 receives igniter 92, when spark igniter mechanism 80 is coupled to burn tube 82.

Igniter 92 is received in housing 94 such that body 98 rests against an inner surface 118 of back end 112 and trigger 100 projects from front end 110. Rectangular portion 114 of housing 94 has a side wall 120 which tapers from front end 110 to back end 112. Tapered side wall 120 enables housing 94 to slide easily over igniter 92 and also to provide a tight fit once igniter 92 is fully inside housing 94.

Housing 94 further includes a hole 122 formed therein and located opposite side wall 120. Hole 122 receives fastener 96 and secures housing 94 over igniter 92 and burn tube 82. Fastener 96 may be a set screw or any other mechanical fastener.

Thus, spark igniter mechanism 80 is coupled to burn tube 82 of torch 84 as follows. Opening 108 is drilled through side wall 106 of burn tube 82. Opening 108 has dimensions preferably slightly larger than that of insulated spark wire 102. Insulated spark wire 102 is trimmed to the appropriate length, so that it projects just past the longitudinal axis of burn tube 82. When spark wire 102 is fully inserted into opening 108, igniter body 98 directly contacts side wall 106 of burn tube 82, and the soft glue which positions spark wire 102 inside of body 98 seals the gap between spark wire 102 and side wall 106. Next, burn tube 82 and igniter 92 are inserted into housing 94 from front end 110. Due to tapered side wall 120, igniter 92 becomes more ensconced in housing 94 as housing 94 is slid further past. Finally, fastener 96 is inserted into hole 122 of housing 94 to secure housing 94 over igniter 92 and burn tube 82.

While the preferred embodiment of the present invention has been described in connection with the Figures, the invention is more general and can be variously embodied by those skilled in the art after reading the present specification. Accordingly, the invention should not be limited to the illustrated embodiments, but should be limited solely by the scope of the claims which follow.

What is claimed is:

1. A spark igniter mechanism for a burn tube having an opening formed in a side wall of the burn tube, consisting of:

a spark igniter coupled to the burn tube, the spark igniter including a body, a trigger coupled to the body and an insulated spark wire coupled to the body, the spark wire extending through the opening of the side wall with a length less than a diameter of the burn tube at the opening;

a one-piece housing surrounding the burn tube and encasing the body of the spark igniter; and a single fastener securing the housing to the burn tube.

2. The mechanism of claim 1, wherein the body of the igniter contacts the side wall of the burn tube.

3. The mechanism of claim 1, wherein the spark wire is covered by a plastic insulator.

4. The mechanism of claim 1, wherein the housing is made of plastic.

5. The mechanism of claim 1, wherein the housing is made of metal.

6. The mechanism of claim 1, wherein the fastener is a screw.

7. A torch comprising:

a burn tube having a single opening formed in a side wall of the burn tube;

a spark igniter coupled to the burn tube, the spark igniter consisting of: a body; a trigger coupled to the body; and an insulated spark wire coupled to the body and extending through the opening in the side wall, wherein the body contacts the side wall of the burn tube;

a one-piece housing surrounding the burn tube and encasing the body of the spark igniter; and a single fastener securing the housing to the burn tube.

8. The torch of claim 7, wherein the spark wire is covered by a plastic insulator.

9. The torch of claim 7, wherein the housing is made of plastic.

10. The torch of claim 7, wherein the housing is made of metal.

11. The torch of claim 7, wherein the fastener is a screw.

12. The torch of claim 7, wherein the housing is further secured by an adhesive.

13. A process for attaching an igniter to a burn tube comprising the steps of:

providing a spark igniter having a trigger, a body and an insulated spark wire;

forming a single opening in a side wall of the burn tube;

inserting the spark wire through the opening of the side wall;

placing the body of the spark igniter in contact with the side wall of the burn tube;

surrounding the burn tube and the body of the spark igniter with a one-piece housing; and securing the housing around the burn tube.

14. The process of claim 13, wherein the spark wire is covered by a plastic insulator.

15. The process of claim 13, wherein the housing is made of plastic.

16. The process of claim 13, wherein the housing is made of metal.

17. The process of claim 13, wherein the housing is secured around the burn tube with a single screw.

18. The process of claim 17, wherein the housing is further secured around the burn tube with an adhesive.

19. A spark igniter mechanism for a burn tube having an opening formed in a side wall of the burn tube, comprising:

a spark igniter coupled to the burn tube, the spark igniter including a body, a trigger coupled to the body and an insulated spark wire coupled to the body, the spark wire extending through the opening of the side wall with a length less than a diameter of the burn tube at the opening;

a one-piece housing surrounding the burn tube and encasing the body of the spark igniter; and a single fastener securing the housing to the burn tube.

20. The spark igniter mechanism of claim 19, wherein the body contacts the side wall of the burn tube.

21. The spark igniter mechanism of claim 20, wherein the spark wire is covered by a plastic insulator.

* * * * *